United States Patent [19]

Sheriff

[11] Patent Number: 4,975,713

[45] Date of Patent: Dec. 4, 1990

[54] MOBILE MESH ANTENNA

[75] Inventor: Jack W. Sheriff, La Jolla, Calif.

[73] Assignee: Modublox & Co., Inc., La Jolla, Calif.

[21] Appl. No.: 211,893

[22] Filed: Jun. 27, 1988

Related U.S. Application Data

[63] Continuation-in-part of Ser. No. 179,788, Apr. 11, 1988, abandoned.

[51] Int. Cl.[5] ..... H01Q 9/28

[52] U.S. Cl. ..... 343/795; 343/713; 343/872; 343/897

[58] Field of Search ..... 343/793, 795, 807, 825, 343/830, 872, 897, 905, 713

[56] References Cited

U.S. PATENT DOCUMENTS

| | | | |
|---|---|---|---|
| 2,094,168 | 9/1937 | Forbes | 343/713 |
| 2,480,155 | 8/1949 | Masters | 343/795 |
| 2,673,931 | 3/1954 | Stevens | 343/795 |
| 2,945,227 | 7/1960 | Broussaud | 343/897 |
| 3,036,302 | 5/1962 | Hudock | 343/795 |
| 3,050,730 | 8/1962 | Lamberty | 343/792.5 |
| 3,268,897 | 8/1966 | Link | 343/713 |
| 3,977,004 | 8/1976 | Bickel | 343/897 |
| 4,746,925 | 5/1988 | Toriyama | 343/713 |

FOREIGN PATENT DOCUMENTS

| | | | |
|---|---|---|---|
| 129485 | 3/1945 | Australia | 343/897 |

OTHER PUBLICATIONS

"Flat, Flexible TV Antenna Offers High Gain", Electronic Design, No. 6, Mar. 15, 1975, vol. 23, (343–897).
Van Nostrand's Scientific Encyclopedia, Fourth Edition 1968, p. 537.
Standard Handbook for Electrical Engineers, Tenth Edition, 1968, pp. 25–137, by Fink and Carroll.
Transmission Lines Antennas and Wave Guides, First Edition, 1945, pp. 130, 133, 144–149, by King, Mimno and Wing.
"Reference Data for Radio Engineers," Fourth Edition, 1956, pp. 662–665.
"Micro-Strip Antenna's", Second Edition, 1982, p. 27, by Bahl and Bhartia.

*Primary Examiner*—Michael C. Wimer
*Attorney, Agent, or Firm*—Henri J. A. Charmasson

[57] ABSTRACT

A panel shaped mesh-type structure is provided as one of the conductive or radiating members of a radio frequency mobile antenna fed by a coaxial cable. The mesh-type structure appears to decouple antenna currents in the coaxial cable at short distances, while maintaining performance as a transmitter at long distances. The radiating elements are surrounded by an insulating material which serves as a dielectric, further improving antenna performance and also serving as environmental protection. The radiating elements are made from readily available mesh and sheet stock materials aligned in a generally planar configuration attached to a either the shield or center lead of the coaxial cable. A small section of the central cable conductor is stripped of insulation and shielding, to serve as a miniature loading coil for the first plate-type conductive element. Shielding of the coaxial cable is attached directly to a mesh-type element serving as the counterpoise. The specific geometries tested produce antenna performance generally insensitive to dielectric variations of as much as 25%.

9 Claims, 1 Drawing Sheet

MOBILE MESH ANTENNA

PRIOR APPLICATION

This application is a continuation in part of a co-pending application Ser. No. 179,788, filed on Apr. 11, 1988, now abandoned.

FIELD OF THE INVENTION

This invention relates to antennas, more specifically to dipole antennas with housings.

BACKGROUND OF THE INVENTION

Antennas for mobile or portable use should be small, light weight, rugged in construction, pleasing in appearance and low in cost. However, more importantly, the antenna must be able to perform as a receiver and transmitter of radio frequency signals within the mobile power source limitations at a high omnidirectional gain in a difficult environment.

Typical mobile transceivers currently employ quarter-wave whip antennas (see: *Standard Handbook for Electrical Engineers*, Tenth Edition, by Donald G. Fink and John M. Carroll, editors, McGraw-Hill, 1968, New York, page 25–74). A fairly uniform omnidirectional vertical polarity pattern is obtained from such installations. However, these antennas require significant space, distance from other conductive materials, specific position with respect to the environment and are usually placed above a horizontal plane.

Various other antenna techniques and structures are also known. These include: employing conducting and non-conductive portions of the mobile structure (see for example: U.S. Pat. Nos. 4,317,121; 4,160,977; 4,117,490; 3,961,330; and 3,916,413); bonding the antenna structure to the non-conductive portions of the mobile structure (see for example: U.S. Pat. Nos. 4,331,961; and 3,646,561); embedding the antenna or caged antenna in the mobile structure (see for example: U.S. Pat. No. 3,717,876) and reducing the dimensions to a small fraction of the wavelength. These approaches typically depend upon added nonconductive material, typically air, as a dielectric to insulate the conductive antenna elements. A final approach is to use a dipole element for the conductive portions.

The use of dipole elements in an antenna can be as simple as a straight radiator fed in the center to produce currents with two nodes, one at each of the far ends of the radiator (see *Van Nostrand's Scientific Encyclopedia*, Fourth Edition, D. Van Nostrand Company, Princeton, N.J., 1968, Page 537). Analysis of the field intensity of these elementary dipole antennas is segregated into short distance (less than 0.01 wavelengths), intermediate (0.01 to 5.0 wavelengths) and great distance (greater than 5 wavelengths), see *Reference Data for Radio Engineers*, Fourth Edition, Published by International Telephone and Telegraph Corporation, New York, 1956, pages 662–665. The two nodes are typically insulated from each other (except at the central point/area of connection) by air. In order to improve tuning and balance, various geometries are used. Two separate radiator elements can also be used. Variations with two separate radiator elements include: slots, altering sizes of nodes, folded radiators and adding/altering the dielectric between the elements (see the section on Slot Antennas, specifically the relationship to metallic dipole antennas, supra, pages 687–689, and U.S. Pat. No. 3,210,766).

Small sizes of antenna are particularly desirable for mobile application, as space and wind resistance consideration may be critical. Patch or microstrip antennas have been developed for this application (see *Micro-Strip Antennas*, 2nd Edition by Bahl & Bhartia, published by Artech House, at Ottawa, Canada, 1982, Page 27). These typically provide a first element (top hat) and second element (ground plane) which sandwich a dielectric material, feed by a coaxial cable. This type of antenna is currently used for cellular communications over the 822–890 MHZ frequency band. This approach produces a very small package, but with limitations.

Limitations of these patch antennas are primarily related to the narrow band of performance and the poor gain produced within that narrow band. Typical gains are in the order of zero to negative 2 Dbd from a standard dipole reference over the same band of frequencies. Frequency band for these "gains" is typically limited to the order of 40 MHZ (less than the entire bandwidth form 822 to 890 MHZ). Other limitations include the sensitivity to other dielectrics proximate to the radiating elements in the environment and exposure of the (conductive) elements, requiring additional protection from shorting or damage.

An additional limitation is related to the unbalance caused by the coaxial cable coupling with respect to the radiating elements, and the unsymmetrical geometry of the antennas (see *Transmission Lines Antennas and Wave Guides*, First Edition, by Ronold W. P. King, Harry Rowe Mimno, and Alexander H. Wing, Published by McGraw-Hill Book Company, 1945, Pages 130–133, 145–149). A coaxial line parallel and feeding the antenna can also have antenna currents, that is currents excited by the antenna. In a metal shield of a coaxial cable, antenna currents may be primarily on the outer surface of the outer conductor. At high frequencies this can cause the coaxial line to act as a three conductor (outer and inner surface currents on the outer conductor as well as transmission currents on the inner conductor). Asymmetrical geometries of the coaxial cable, impedance sections and antenna also lead to unwanted antenna currents. Prior art concentrated on the geometry and spacing of the two radiating and coaxial elements to minimize these problems with unwanted antenna currents.

SUMMARY OF THE INVENTION

The principal and secondary objects of the invention are:

- To provide a smaller, more rugged mobile antenna especially suited to cellular bandwidths;
- To provide an antenna with improved bandwidth and gain performance without the prior art geometry limitations; and
- To provide an antenna less susceptible to environmental damage or impacts on performance.

These and other objects are achieved by providing a panel shaped mesh structure for one of the radiating members. The mesh structure tends to decouple antenna currents in the coaxial cable at short distances, while maintaining performance to receivers at long distances. The radiating elements are surrounded by an insulating material which serves as a dielectric, further improving antenna performance and also serving as environmental protection. The conductive elements are readily available mesh and sheet stock materials aligned in a generally planar configuration attached to a coaxial cable. A small section of the central cable conductor is stripped of insulation and shielding, to serve as a miniature loading coil for the quarter wave top section loading of the first sheet conductive element. Shielding of the coaxial cable is attached directly to a second conductive element made from a mesh panel, serving as the counterpoise. The specific geometries tested produce antenna performance generally insensitive to dielectric variations of as much as 25%.

DESCRIPTION OF THE PREFERRED EMBODIMENT

Figure 1:
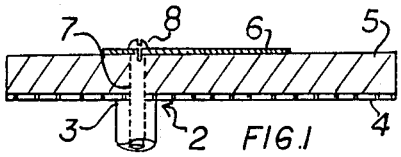
FIG. 1 shows a prior art implementation shows a side cross sectional view of a prior art patch antenna.

FIG. 1 shows a top view of a prior art patch or microstrip antenna. Coaxial cable 2 connects the antenna to a generator (not shown for clarity) which supplies the signal to be transmitted. Shielding 3 of the cable 2 is attached to a plate or ground plane 4. Ground plane 4 is one pole of the dipole antenna and is composed of a conductive sheet which sandwiches insulator slab 5 on one side. Partially covering the other side of insulator 5 is the second pole of the dipole antenna or active plate or top hat 6. The second pole or plate 6 is connected to the center conductor 7 (shown dotted for clarity) of coaxial cable 2 by screw 8, which also holds the assembly together. Bonding plates 4 and 6 to insulator 5 is an alternate assembly technique. The thickness of insulator 5 and dimensions of plates 4 and 6 are chosen to maximize performance over the frequencies of interest.

Figure 2:
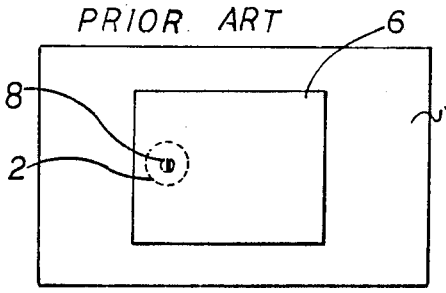
FIG. 2 shows a top view of the prior art patch antenna.

FIG. 2 shows a top view of the conductive element of a prior art mobile antenna. Insulator slab 5 is partially covered by active plate 6. Screw 8 attaches active plate 6 to the center conductor of coaxial cable 2 (shown dotted for clarity). Environmental protection from shorting active plate 6 is optional and is not shown.

Figure 3:
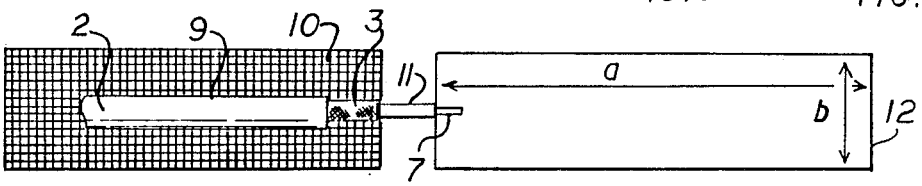
FIG. 3 shows a top view of the conductive elements of a mobile antenna embodiment.

FIG. 3 shows a top view of the conductive elements of a preferred embodiment of a mobile antenna. Coaxial cable 2 again supplies the radio frequency signal to be transmitted from a generator or other radio communications device (not shown for clarity). Outer insulating jacket 9 is stripped from cable 2 to expose conductive shielding or outer conductor 3. Shielding 3 is conductively attached to first active or conductive mesh element 10, also known as counterpoise plane. Mesh-type element 10 is panel shaped and similar but not equal to plate or ground plane 4 of FIG. 1 because of the mesh construction and the orientation with respect to the active element. Mesh-type element does not have to be a flat or parallelepiped element as shown (i.e.: it may be concave or have multiple curves). The first mesh-type element also does not have to be a woven construction, but must consist of multiple interconnected conductive wires in the element. The preferred embodiment of the mesh-type element 10 is a planar section of multiple brass wires, woven into a 40×40 mesh, that is 40 openings between wires per 2.54 cm (1 inch) distance in a first direction and 40 openings per 2.54 cm (1 inch) distance in a direction perpendicular to the first direction.

Coaxial insulator 11 surrounds the center conductor 7 of coaxial cable 2 for a short distance between counterpoise element 10 and second conductive planar or active plate element 12, to serve as a connector and/or loading coil (inductance). An alternate configuration would have the coaxial insulator 11 removed over this short distance, as this would not impact performance, but presence of insulator prevents the accidental contact of shielding 3 and conductor 7, or the accidental contact of center conductor 7 to mesh-type element 10. The center conductor is conductively attached to the second panel-shaped element 12 which is located adjacent to, but not adjoining counterpoise panel 10. The distance is selected to configure the short unshielded center conductor to act as a loading coil for matching the impedance in order to maximize performance.

The second panel-shaped element 12 does not necessarily have to be the shape of a parallelepiped as shown (i.e.: it may be concave or have multiple curves), but must have a predominant radiating surface for the radio frequency signals. The preferred embodiment is composed of brass shim stock sheeting, cut to specific dimensions which maximize performance of the antenna within a container envelope. Thickness (not shown in this figure, in the plane of the paper) is in the range of 0.13 to 0.25 mm (0.005 to 0.010 inches). In the preferred embodiment shown, the overall dimensions a and b of the second element 12 are generally similar to the mesh element 10. First dimension a in the preferred embodiment is 6.4 cm (2.5 inches), and second dimension b is 1.9 cm (0.75 inch). Other configurations can vary the dimensions and geometric shapes of the first and second active elements to match envelope limitations, and the directional, frequency, and performance objectives. Alternate embodiments of the second panel-shaped element could substitute a second mesh-type element, a concave/convex shaped elements, or an irregular, but generally panel-shaped element.

The specific dimensions shown were obtained by experimentation to fit within the dielectric container (shown in FIG. 7) and supplied with radio signals in the frequency band of 822 to 890 MHZ through a coaxial cable. The dimensions of the preferred embodiment gave the maximum performance in these experiments within these constraints.

Figure 4:
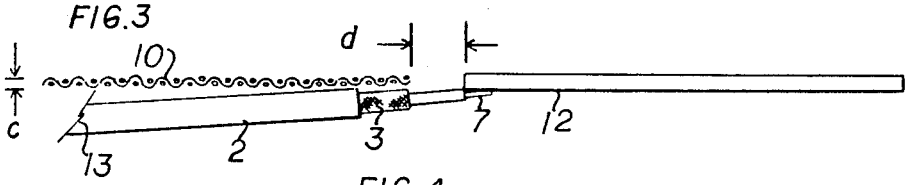
FIG. 4 shows a side view of the conductive elements.

FIG. 4 shows a side view of the embodiment shown in FIG. 3. Coaxial cable 2 supplies the signal to be transmitted (generator not shown for clarity) to supply point 13. Shielding 3 is tin soldered or otherwise electrically connected to the mesh element 10. Thickness c of first mesh-type element 10 and second active element 12 has been tested in the range from 0.13 to 0.25 mm (0.005 to 0.010 inch) in this configuration, but is not expected to be critical if significantly less than major dimensions a and b (see FIG. 3). Dimension d is the separation between the first and second conductive elements. In testing, the optimum dimension d was found to be comparable to the diameter of the coaxial cable of 0.64 cm (0.25). Center conductor 7 is tin soldered or otherwise electrically connected to active element 12.

Figures 5, 6:
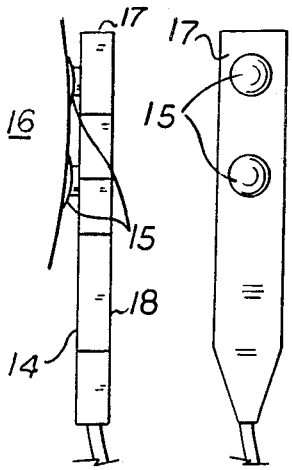
FIG. 5 is a side view of the assembled mobile antenna.
FIG. 6 shows a front view of the container.

FIG. 5 is a side view of the assembled mobile antenna with the conductive or radiating elements within a dielectric container 14. Container 14 completely surrounds the conductive elements shown in FIG. 3, except for a feedthrough of the coaxial cable 2 leading to the signal generator (not shown for clarity). Two suction cups 15 are provided as a convenient means to attach the assembled antenna to a portion of vehicle 16. Vehicle 16 portion in the preferred embodiment is a glass window. This allows a 360 degree field for the antenna. The configuration will also function well if vehicle portion 21 is another nonconductive element, such as plastic body components. Container 14 can be formed from two half container sections, a suction section 17 and a cover section 18. Half sections can snap together or be adhesively bonded. Material of construction is selected as having a dielectric strength greater than air and sufficient structural strength and flexibility to protect the conductive elements. A plastic with a dielectric strength of 2.5 at 1 GHZ was used for the preferred embodiment, but testing with dielectric strengths varying from this value by 25 percent also showed acceptable performance. The container sections 17 and 18 are also ribbed for added strength, with the ribs contacting the conductive plates at the edges. Remainder of the containers were within approximately 0.32 cm ($\frac{1}{8}$ inch) of the conductive surface area. The thin plate and mesh materials of construction also allowed deformation of the container during handling without damage.

FIG. 6 shows a front view of the container 14. Suction section 17 contains the two suction cups 15 which provide attachment to the vehicle (not shown in this view for clarity).

Figure 7:
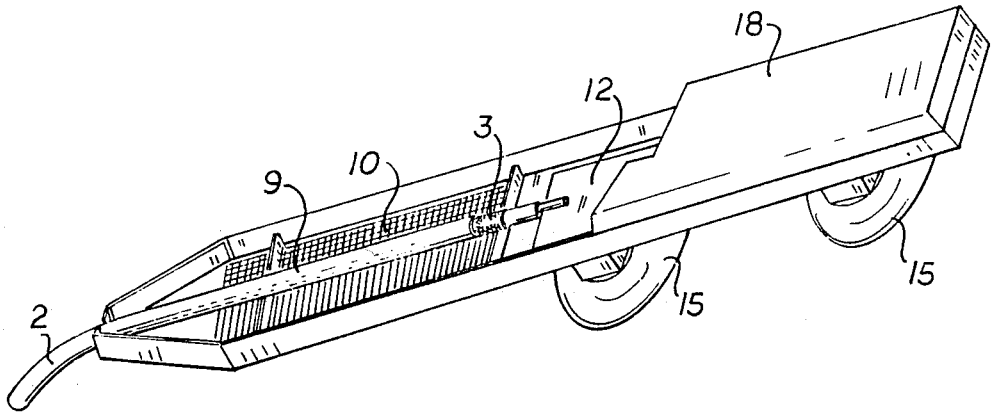
FIG. 7 shows a perspective partial section view of an assembled mobile antenna.

FIG. 7 shows a perspective partially sectioned view of an assembled mobile antenna. Cover section 18 has been partially sectioned to expose the interior of suction section 17. Cable 2 is passed though a port (having a dimension comparable to the diameter of the cable 2) in the container to the interior where it passes over the first mesh-type element 10 to the edge proximate to the second element 12. Outer jacket 9 is removed and shield 3 is attached to the first mesh-type element 10 at this point. Unshielded center conductor continues and is attached to the nearest edge of second element 12, which is partially obscured in this view. Suction cups 15 again provide a convenient means for removably attaching the mobile antenna to a vehicle (not shown for clarity). Although both conductive elements 10 and 12 are mounted on a common non-conductive material (container), another configuration (not shown) provides a separate non-conductive material that both elements are mounted on prior to insertion into the container, allowing ease of assembly of mounted elements into the container.

While the geometry of the preferred embodiment has been described, many other geometries are possible. The mesh element 10 could essentially replace the base element hat 5 of FIGS. 1 and 2. The conductive elements of FIGS. 1 and 2 (with mesh replacing base element 4) could also be placed within a dielectric container similar to container 14 shown in FIG. 5 except shaped to conform to the external dimensions of the conductive elements.

While the preferred embodiment of the invention has been shown and described, as well as some other embodiments, changes and modifications may be made therein within the scope of the appended claims without departing from the spirit and scope of this invention.

What is claimed is:

1. An antenna connected to a radio communications device by first and second conductors, said antenna comprising:

a first conductive panel-shaped open-weave mesh element, said first conductor being connected to one edge of said element;

a second generally solid planar conductive element having an edge adjacent to said one edge of said mesh element and connected to said second conductor, wherein said first and second conductors are proximate alongside one of said conductive elements;

a container completely enclosing and generally spaced apart from said conductive elements, said container being made of a dielectric material;

wherein said container is composed of material having a dielectric constant greater than 2;

wherein said generally planar element is a thin parallelepiped made of brass shim stock material having a thickness ranging from 0.13 mm to 0.25 mm;

wherein said mesh element is a parallelepiped made of brass wire 0.0254 cm in diameter woven in a 40×40 mesh, having 40 openings per 2.54 cm vertically, 40 openings per 2.54 cm horizontally;

wherein said conductors are within a coaxial cable having a specific diameter, said coaxial cable comprising an outer insulating jacket, a shielding sleeve acting as the first conductor, an intermediate insulator, and a central lead forming the second conductor; and wherein the distance between said adjacent edges is generally equal to the diameter of said coaxial cable.

2. The antenna as claimed in claim 1, wherein said mesh element and said second generally planar element have generally symmetrical external dimensions.

3. The antenna as claimed in claim 2, wherein the largest dimension of said mesh element and said second generally planar element is approximately 6.4 cm.

4. The antenna as claimed in claim 3, wherein said mesh element and said second generally planar element are mounted on a common non-conductive planar substrate.

5. The antenna as claimed in claim 4, wherein said conductive elements and said container are deformable, and said container contacts the edges of said conductive elements and is capable of deforming with said conductive elements under load.

6. The antenna as claimed in claim 5 which also comprises means for removably attaching said container to a mobile vehicle.

7. The antenna as claimed in claim 6, wherein said means for removably attaching consists of unsymmetrically placed suction cups attached to said container and capable of securing to said mobile vehicle.

8. The antenna as claimed in claim 7, wherein said conductive elements are generally spaced within 0.32 cm of said dielectric material of said container.

9. The antenna as claimed in claim 8, wherein said diameter of said coaxial cable is approximately 0.64 cm.

* * * * *